United States Patent [19]

Errett

[11] 4,229,146

[45] Oct. 21, 1980

[54] AIR COMPRESSORS

[75] Inventor: Paul W. Errett, Greensburg, Pa.

[73] Assignee: Airtek, Inc., North Huntingdon, Pa.

[21] Appl. No.: 8,472

[22] Filed: Feb. 2, 1979

[51] Int. Cl.[3] ..... F04B 49/00

[52] U.S. Cl. ..... 417/281; 417/282; 417/297.5; 417/542

[58] Field of Search ..... 417/13, 281, 282, 297, 417/297.5, 298, 540, 542

[56] References Cited

U.S. PATENT DOCUMENTS

| | | | |
|---|---|---|---|
| 1,688,990 | 10/1928 | Schreiber | 417/281 |
| 2,065,204 | 12/1936 | Aikman | 417/281 |
| 2,405,100 | 7/1946 | Stephens | 417/540 X |
| 2,472,553 | 6/1949 | Theunissen | 361/154 |
| 2,474,555 | 6/1949 | Stephens | 417/542 |
| 2,548,472 | 4/1951 | Gibson | 417/542 |
| 2,570,965 | 10/1951 | Meyers | 417/274 |
| 2,649,241 | 8/1953 | Cady | 417/298 |
| 2,889,106 | 6/1959 | Le Valley | 417/253 |
| 2,937,801 | 5/1960 | Berkoben | 417/281 |
| 3,380,650 | 4/1968 | Drummond et al. | 417/280 |

*Primary Examiner*—Billy J. Wilhite

*Attorney, Agent, or Firm*—Buell, Blenko & Ziesenheim

[57] ABSTRACT

An air compressor assembly is provided having a high pressure air receiver, a compressor, an outlet port and an inlet port on said compressor, said inlet port having a normally closed spring loaded inlet valve, the improvement comprising a two position normally open spring loaded poppet valve on said compressor, oil pressure actuator means acting on said poppet valve opposite said spring, receiving pressure oil from a pressure lubricating system in said compressor to close said poppet valve against the spring in normal operation of the compressor, a pulsation damper having upper and lower chambers connected by a metering means between the compressor and air receiver, a connection from the compressor to the lower chamber delivering high pressure air thereto, a connection from the lower chamber to the air receiver, a connection from the upper chamber to the poppet valve on the same side as the spring, a pressure responsive actuator means selectively acting on the inlet valve, and a connection from the poppet valve to said pressure responsive actuator means acting to deliver pressurized air from the poppet valve to open the inlet valve when the poppet valve is in its open position.

8 Claims, 5 Drawing Figures

AIR COMPRESSORS

This invention relates to air compressors and particularly to a double chamber pulsation damper and air compressor incorporating the same most especially those used on wheeled vehicles, such as transit vehicles.

Air compressors of many types and sizes designed for a great variety of uses have long been available. One of the major users of air compressors is the transit industry where compressors are used to supply air under high pressures for a great variety of purposes from operating brakes to opening doors. In the case of transit systems, air compressors are required to have a very high degree of reliability and a relatively long life under substantially continuous use.

A very real problem in all such compressors is that of unloading the compressor for start up and providing a proper supply of oil to the compressors moving parts during operation. Another problem of particular significance in transit compressors is that of removing water from the system.

I have invented an air compressor structure incorporating a double chamber pulsation damper and starting unloader and low oil pressure interlock device which effectively overcomes the problems of unloading the compressor, providing a low oil pressure interlock while protecting the same against high pressure surges and water accumulation.

I provide in an air compressor having a high pressure air receiver and a cylinder head with at least one inlet port having a normally closed spring loaded valve, a two position, three way spring loaded poppet type valve which is normally open under pressure from the spring, diaphragm means acting on one side of said poppet valve, opposite said spring, said diaphragm means being subject to oil pressure in said compressor to close said poppet in operation, a connection from the high pressure air receiver to the other side of said poppet valve, inlet valve unloader means in said inlet port connected to said poppet valve a double chamber pulsation damper having a bottom chamber, an inlet port in said bottom chamber receiving air under pressure and an outlet port discharging air under pressure to a system requiring air and a top chamber connected to said bottom chamber through a metering opening and connection means connecting said top chamber to said poppet opposite the diaphragm connection whereby when the oil pressure falls below a selected safe level said poppet shifts to its open position and directs air to said inlet valve unloader means to hold the inlet port open. Preferably the outlet port is at the bottom of the bottom chamber whereby condensed moisture is flushed out of the chamber with the air. In a preferred embodiment, an external unloading valve is provided sensing a selected unloading and a selected loading pressure to unload the compressor at the selected level and load it when pressure drops to the selected loading pressure.

In the foregoing general description certain objects, purposes and advantages of this invention have been set out. Other objects, purposes and advantages of this invention will be apparent from a consideration of the following description and the accompanying drawings in which.

Figure 1:
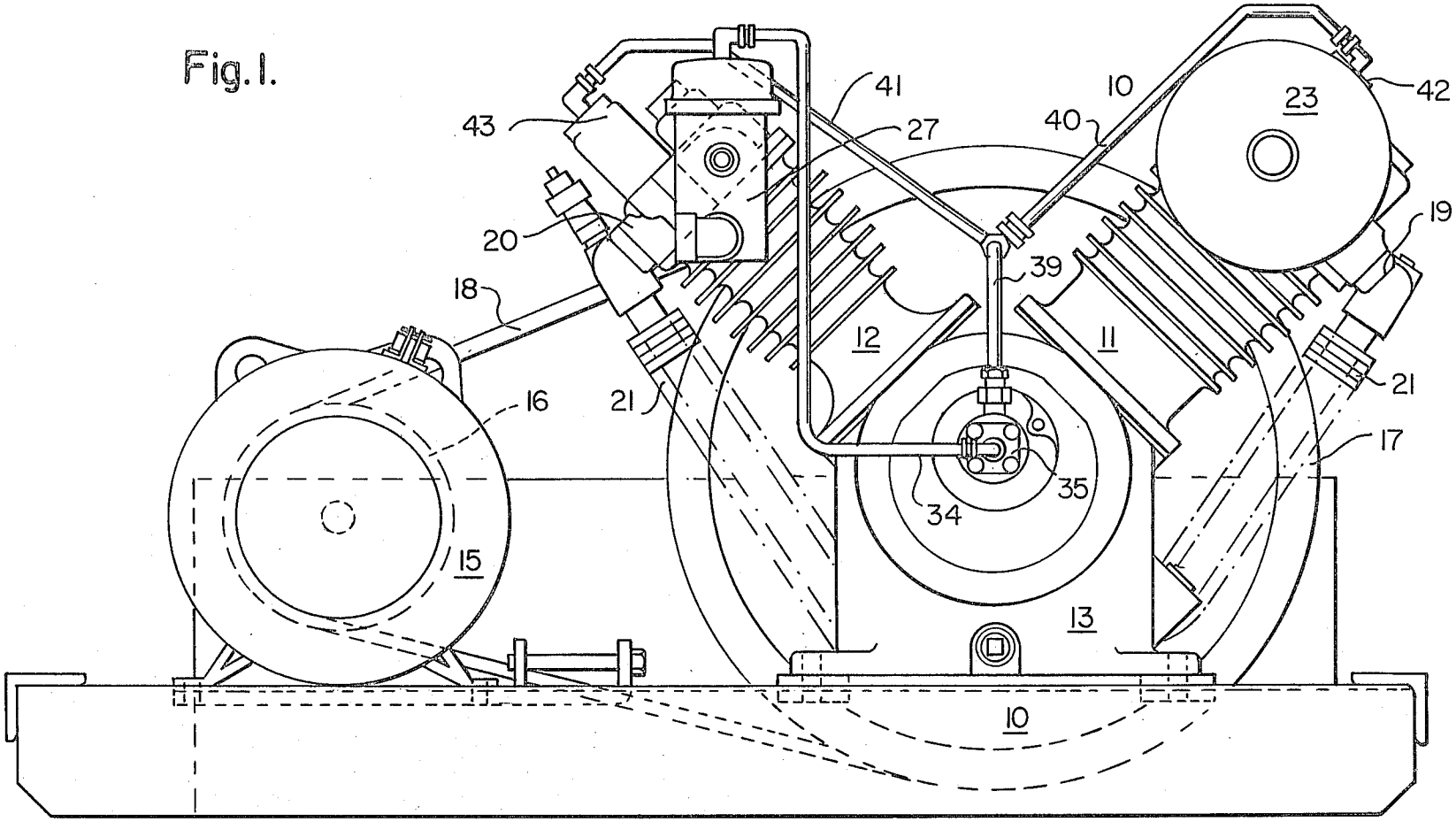
FIG. 1 is a side elevation of an air compressor assembly incorporating this invention.
Figure 5:
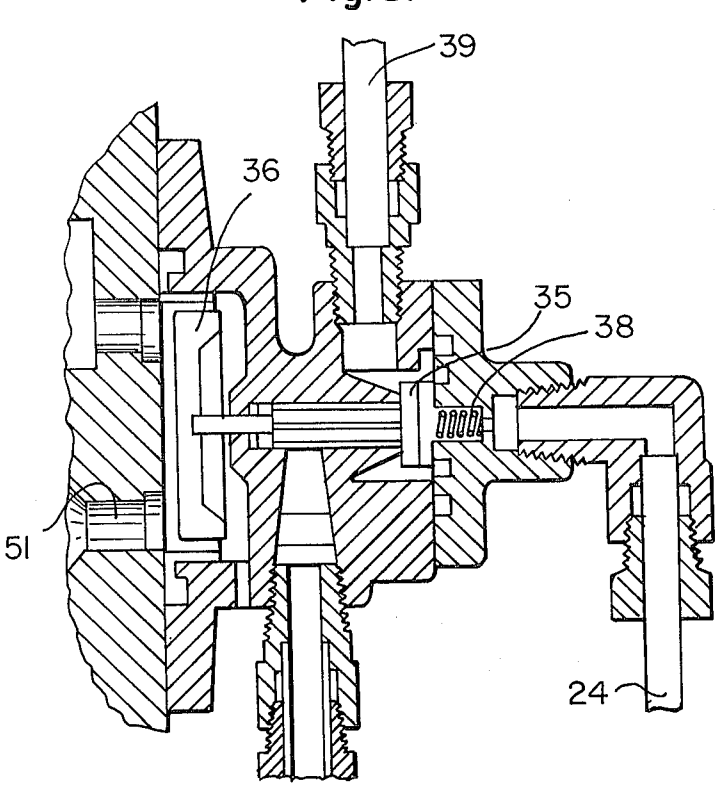
FIG. 5 is an enlarged fragmentary view of the poppet valve structure.
Figure 2:
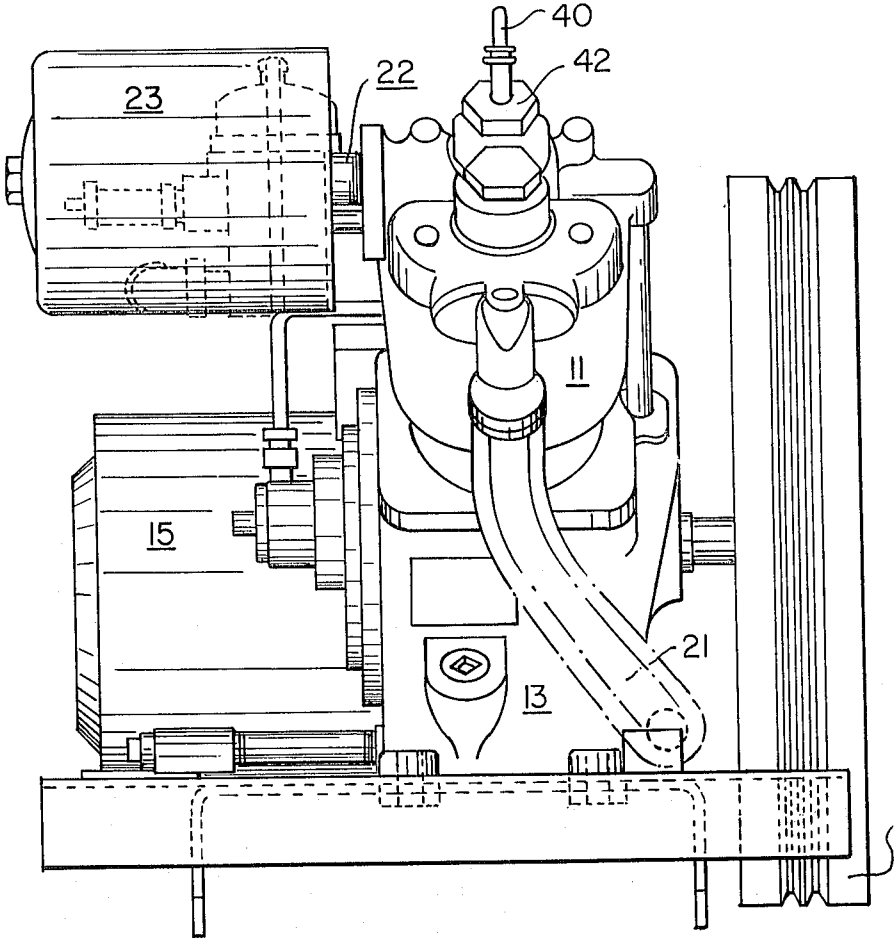
FIG. 2 is an end elevation of the air compressor of FIG. 1.
Figure 3:
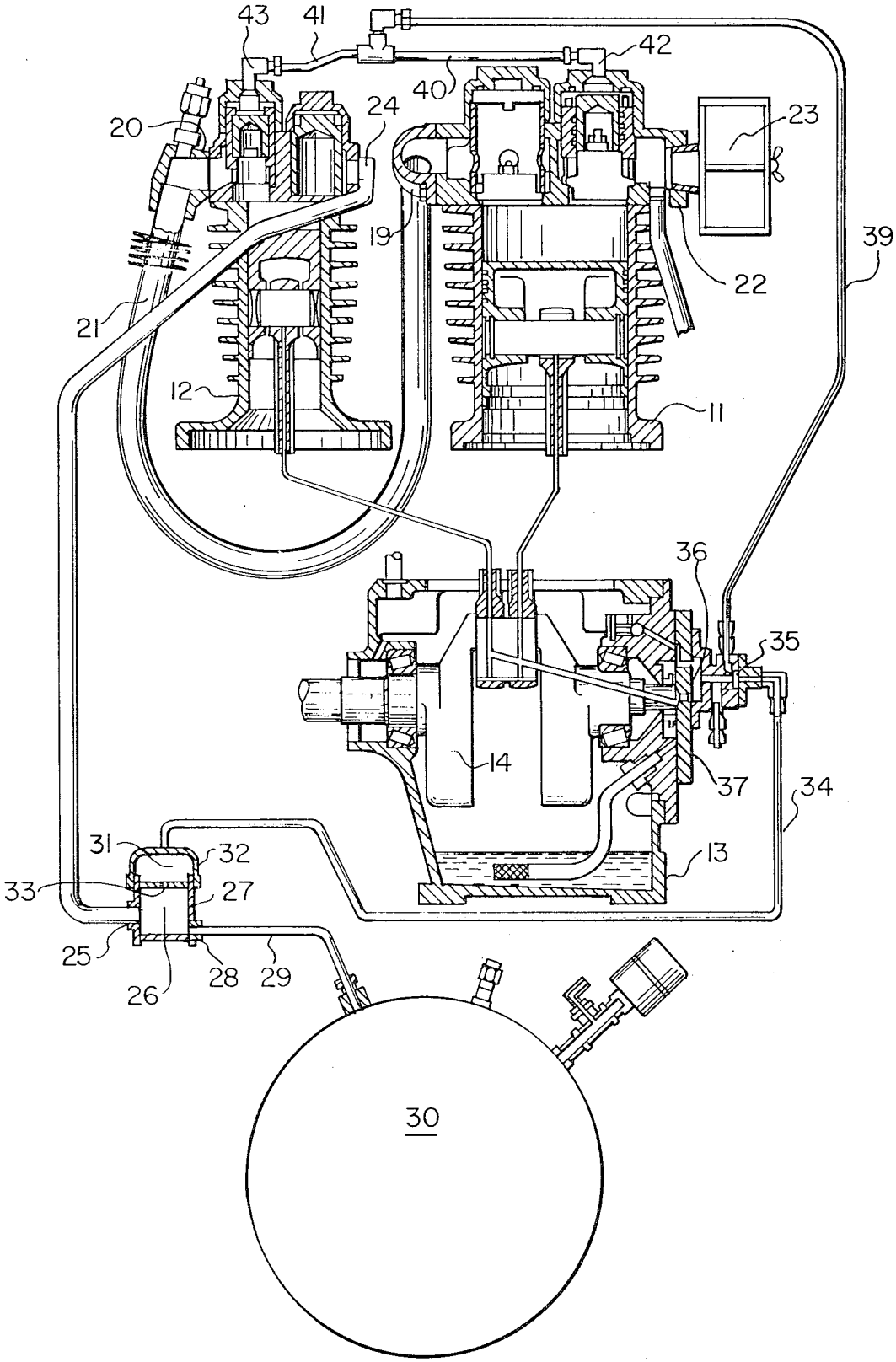
FIG. 3 is a schematic section of the air compressor of FIGS. 1 and 2.
Figure 4:
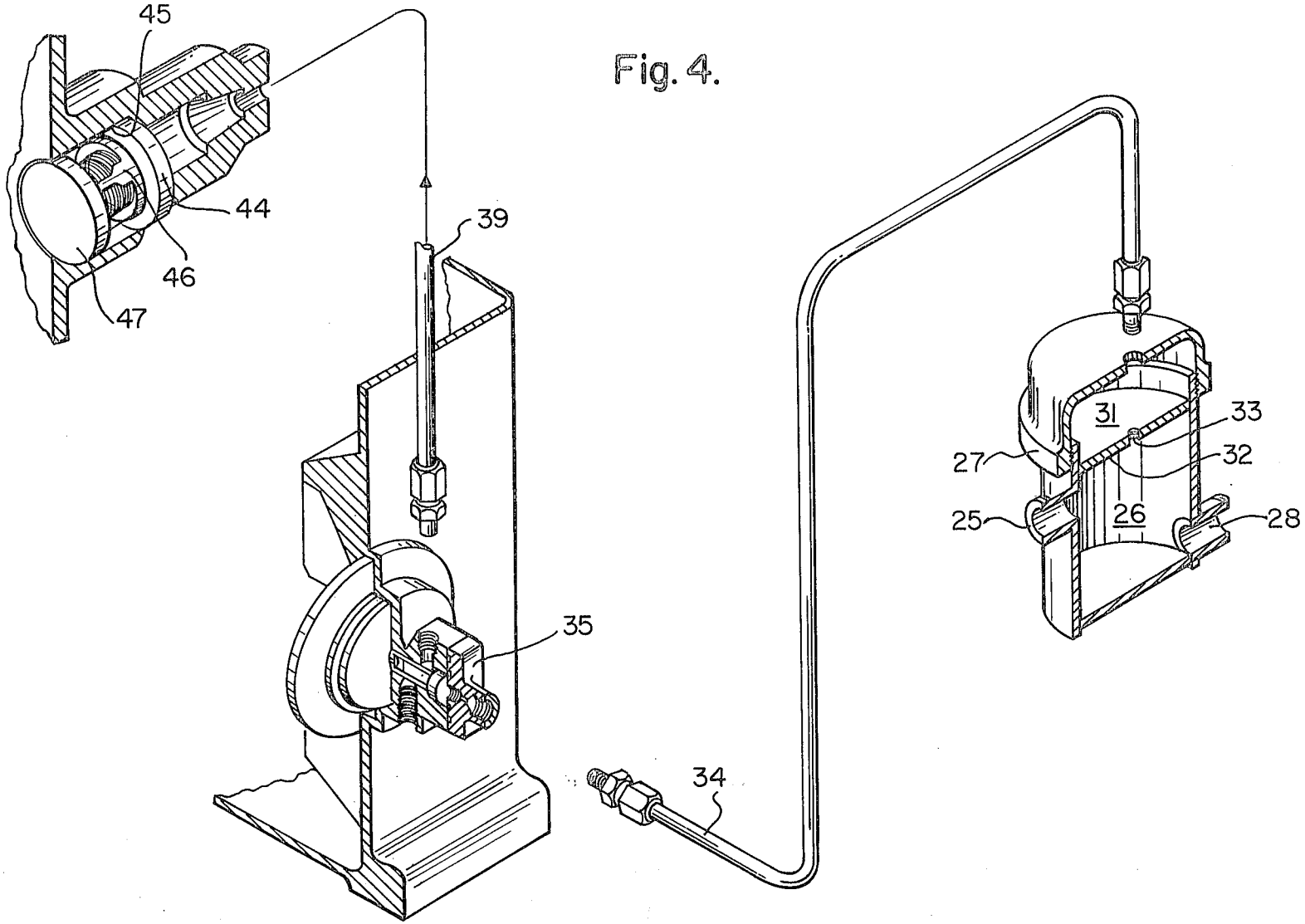
FIG. 4 is an exploded fragmentary view of the preferred structure of poppet valve, valve unloader and double pulsation damper used in the air compressor of this invention.

Referring to the drawings there is illustrated a conventional compressor 10 having a low pressure cylinder 11 and a high pressure cylinder 12 mounted in a 90° V formation on base 13 and driven by a common crankshaft 14 and drive motor 15 by way of pulleys 16 and 17 and V belts 18. The discharge port 19 of low pressure cylinder 11 is connected to the inlet port 20 of high pressure cylinder 12 by finned conductor pipe 21. Inlet port 22 of the low pressure cylinder is connected to a dry type air filter 23. The outlet port 24 of high pressure cylinder 12 is connected to inlet 25 of the bottom chamber 26 of a double chamber pulsation damper 27. An outlet 28 at the bottom of bottom chamber 26 is connected to pipe 29 going to air receiver or storage tank 30. The top chamber 31 of damper 27 is separate from bottom chamber 26 by a dividing wall 32 having a metering orifice 33 in the center thereof of such size as to provide a restricted or meter flow of air between the chambers and to prevent sudden changes in pressure in the top chamber 31 by damping the flow between them. The top chamber 31 is in turn connected by line 34 with one side of a poppet valve unloader and low pressure interlock 35 mounted in the sidewall of base 13 which also provides the oil sump for the compressor. The opposite side of poppet valve 35 is connected to a diaphragm actuator 36 which is acted upon by oil pressure from oil pump 37 on the end of crankshaft 14 to overcome spring 38 which normally holds valve 35 in the open position except when the compressor is running and the oil pressure is sufficient to overcome the spring pressure and the pressure from line 34. If the valve 35 is opened by reason of the oil pressure dropping below a safe minimum then air from chamber 31 acting through line 34 passes through valve 35 to line 39 from whence it passes by lines 40 and 41 to inlet valve unloaders 42 and 43 on the low pressure cylinder 11 and the high pressure cylinder 12. These unloaders are pistons 44 in cylinders 45 having fingers 46 which extend through the inlet port to the inlet valve disc 47 to open the valve disc in the inlet port and hold it open so long as the valve 35 remains open. Thus for proper operation an adequate level of oil must be present in the sump 13 and the oil pump must be functioning properly. If there is insufficient oil pressure the compressor will be automatically unloaded, thus protecting the compressor against wear and indicating a malfunction by the loss of air pressure.

As indicated above the compressor may also include a modified piping system having an external unloading valve such as a Conrader Valve directing pressurized air to the unloader. The operation of such a system is conventional and will not be described in detail.

In the foregoing specification certain preferred embodiments and practices of this invention have been set out, however, it will be understood that this invention may be otherwise embodied within the scope of the following claims.

I claim:

1. In an air compressor assembly having a high pressure air receiver, a compressor, an outlet port and an inlet port on said compressor, said inlet port having a normally closed spring loaded inlet valve, the improvement comprising a two position normally open spring loaded poppet valve on said compressor, oil pressure actuator means acting on said poppet valve opposite said spring, receiving pressure oil from a pressure lubricating system in said compressor to close said poppet valve against the spring in normal operation of the compressor, a pulsation damper having upper and lower chambers connected by a metering means between the compressor and air receiver, a connection from the compressor to the lower chamber delivering high pressure air thereto, a connection from the lower chamber to the air receiver, a connection from the upper chamber to the poppet valve on the same side as the spring, a pressure responsive actuator means selectively acting on the inlet valve, and a connection from the poppet valve to said pressure responsive actuator means acting to deliver pressurized air from the poppet valve to open the inlet valve when the poppet valve is in its open position.

2. An air compressor assembly as claimed in claim 1 wherein the pressure responsive actuator means acting on the inlet valve is an air actuated piston having fingers engaging the inlet valve.

3. An air compressor assembly as claimed in claim 1 or 2 wherein the metering means is a restricting orifice in a wall separating the upper and lower chambers of the pulsation damper.

4. An air compressor assembly as claimed in claim 1 or 2 wherein the compressor has a reciprocating piston in a cylinder closed by a cylinder head carrying an inlet port, and a spring loaded normally closed inlet valve in said inlet port.

5. An air compressor as claimed in claim 1 or 2 or 4 wherein the connection from the air compressor to the pulsation damper is at the top of the lower chamber and the connection from the pulsation damper to the air receiver is at the bottom of the lower chamber.

6. A pulsation damper for an air compressor having a high pressure air outlet, a pressure actuated inlet valve unloader and an air receiver comprising an elongated closed vessel, a dividing wall intermediate the ends of said vessel forming an upper and a lower chamber, metering means communicating through said wall between said chambers, an inlet in said lower chamber to be connected to the compressor outlet, an outlet in said lower chamber to be connected to the air receiver and a connection from the upper chamber to said inlet valve unloader.

7. A pulsation damper as claimed in claim 6 wherein the metering means is a restricting orifice.

8. A pulsation damper as claimed in claim 6 or 7 wherein the inlet into the lower chamber is at the top and the outlet from said lower chamber is at the bottom.

* * * * *